United States Patent [19]

Stephens, Jr.

[11] Patent Number: 4,847,955

[45] Date of Patent: Jul. 18, 1989

[54] KEY HOLDER

[76] Inventor: Albert L. Stephens, Jr., 232 June St., Los Angeles, Calif. 90004

[21] Appl. No.: 167,530

[22] Filed: Mar. 14, 1988

[51] Int. Cl.[4] ..... A45F 5/02

[52] U.S. Cl. ..... 24/3 K; 24/546

[58] Field of Search ..... 24/3 K, 3 E, 3 D, 3 M, 24/20 S, 20 EE, 20 LS, 26, 27, 265 AL, 129 C, 131 R, 546, 599, 625, 622, 698, 67.3, 67.9; 70/456 R

[56] References Cited

U.S. PATENT DOCUMENTS

| | | | |
|---|---|---|---|
| 769,418 | 9/1904 | Vancore | 70/456 R |
| 988,103 | 3/1911 | Jarrell | 24/3 D |
| 1,121,801 | 12/1914 | Childress | 24/26 |
| 1,198,105 | 9/1916 | Butler | 24/3 K |
| 1,550,406 | 8/1925 | Wilson | 24/3 K |
| 1,922,594 | 8/1933 | Lippstadt | 24/3 K |
| 2,810,943 | 10/1957 | Klancnik, Jr. | 24/27 |
| 2,828,900 | 4/1958 | LeRoy | 24/3 D |
| 2,969,668 | 1/1961 | Aitchison | 70/456 R |
| 4,523,354 | 6/1985 | Tsukamoto | 24/546 |
| 4,658,822 | 4/1987 | Kees, Jr. | 24/546 |

*Primary Examiner*—Victor N. Sakran
*Attorney, Agent, or Firm*—William K. Rieber

[57] ABSTRACT

A key holder consisting of an elongate, one-piece body of springlike material formed into a loop with overlapping lateral surface contacting end portions. In one version the end portions are sinuously formed so as to cam apart upon finger pressure being applied to the loop sides. Another version has end portion tip bent to embrace loop sides, in another the end portions sinuous in the loop plane, and in a still further version the overlapping end portions are each formed by doubling the body material back onto itself.

9 Claims, 4 Drawing Sheets

KEY HOLDER

The present invention relates generally to key holders or key rings, and, more particularly, to an improved key holder which is conveniently operable to engage or disengage a key.

BACKGROUND OF THE INVENTION

Key holders and key rings have been used almost as long as keys themselves, and like keys, the devices used to hold a set of keys together have become more complex and intricate. Some of the key holders presently in use are heavy, bulky, mechanically complex or have sharp edges which can damage clothing. Still others are difficult to use and can cause broken fingernails on attempting to add or subtract keys. These are all undesirable features.

In addition to any one or more of the noted undesirable features, known devices do not fully satisfy the current demand for convenience. For example, with the increase in popularity of automatic car washes, valet parking, and the like, the ability to easily remove a key or keys from the key holder has made convenience an important element in the usefulness of a key holder. A key holder with keys attached which can be easily removed from or added to the ignition lock key of a running automobile engine is also a great convenience not found in key holders presently in use. Also, to be able to quickly and easily remove any number of keys from a key holder in any order of priority for whatever reason is desirable. A solution to avoiding undesirable features of key holders presently in use and providing the convenience which contemporary society demands is the subject of this invention.

SUMMARY OF THE INVENTION

According to the present invention, there is provided an improved key holder constructed of material which can pass through the eye of a key and formed into a loop, the two end portions of which overlap and press against each other, over approximately ¼ of the loop perimeter for example. The configuration of the loop is such that by squeezing the body of the loop on either side of the ends (i.e., applying a force in the plane of the loop), it is deformed so that the two ends slide against each other causing the ends to protrude from the loop. The loop can be made of one piece of material of uniform composition and flexibility or of flexible portions and non-flexible portions made of similar or different materials to produce a loop which will provide all essential flexibility.

The protruding ends provide the means for a key to enter or leave the loop. A key enters the loop by threading it on to a projecting end and sliding it in the same direction until it passes the overlapping ends portion of the loop. A key is removed from the loop by sliding it toward a projecting end and off. Either adding or removing a key from the loop can be accomplished in one quick motion.

After insertion or removal of a key, the loop is released allowing it to return to its original configuration which permits all keys placed onto the loop to move freely around the closed loop. Any key on the loop can be removed at any time. Also, a chain for attachment to the person or clothing can be interconnected to the holder as easily as the individual keys.

The loop material is inherently spring-biased to return to its original configuration as an endless loop when the body of the loop is no longer squeezed which assures that it will not accidentally open to permit the loss of a key. The two end portions of the loop overlappingly engage each other and are formed along the contacting surfaces permitting relative sliding movement with little friction when the body of the loop is squeezed to add or subtract a key or keys. The combined thickness of the respective end portions should be such as to easily pass through the eyes of keys on the loop when the body of the loop is not being squeezed.

In operation, the loop is squeezed between thumb and forefinger causing the ends to move in the loop plane and extend outwardly of the loop. A key can be threaded onto either of the protruding ends to enter the loop by sliding it past the overlapping end portions onto the loop. In removing a key, the loop is squeezed as before and the key is removed by sliding it along the loop toward a protruding end and off. Due to the springlike consistency of the key loop material, it automatically returns to its original configuration once squeezing is stopped. Attached keys are unable to "fall off" the key loop because the ends are no longer open and the device once again resembles a closed loop.

In a preferred embodiment, the two end portions are bent along the plane of abutting surfaces to form a generally sinuous or S-like nested interface. This construction causes the two ends to protrude when squeezed, as already explained, and, in addition, to open at right angles to the loop plane as the curved portions become unnested providing an opening to receive a key and reducing the distance which the key itself must slide along the abutting surfaces to enter or leave the loop. The "S" like interface facilitates return of the two ends to a fixed position, further preventing keys from falling off the ring, while still permitting the rotation of keys on the ring to position any one for removal.

Special material alloys are known to have the characteristic of unfailingly returning to an original shape and these can be usefully employed in construction of this invention. See the January 1988 issue of *Popular Science*, page 78, "Metals That Remember" by Steven Ashley.

DESCRIPTION OF PREFERRED EMBODIMENTS

In accordance with the present invention, there is provided an improved key holder or ring for holding one or more keys, which is especially advantageous in allowing for ready and convenient attachment and disengagement of keys.

FIRST VERSION

Figure 1:
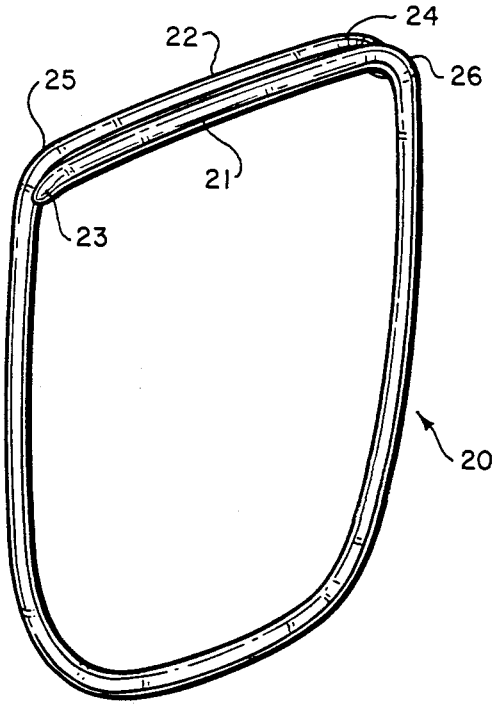
FIG. 1 is a perspective view of a first version of the invention in the "closed" position.
Figure 2:
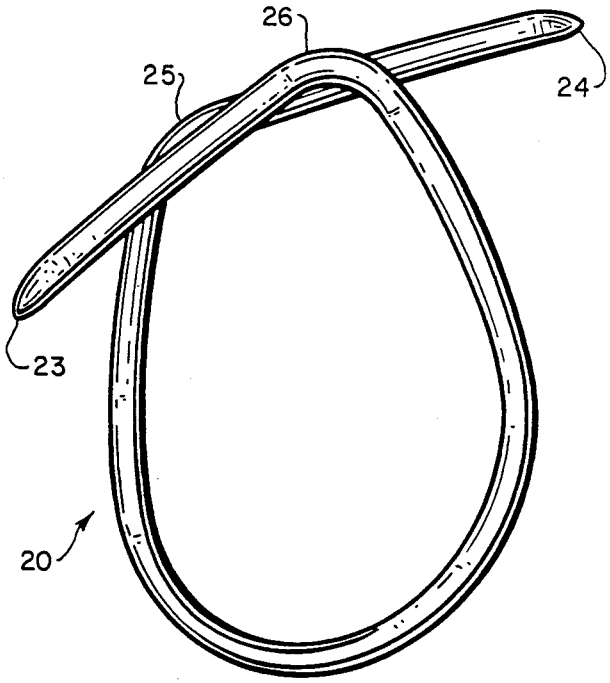
FIG. 2 is a side elevational view of the invention depicted in "open" position for receipt or discharge of a key.
Figure 3:
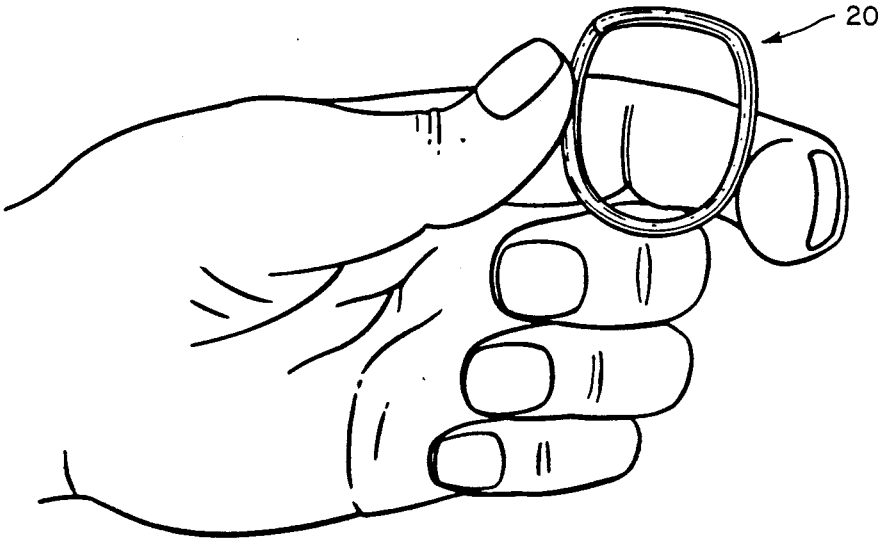
FIG. 3 is a perspective view of FIG. 1 in the hand of a person using the invention.

A first version of this invention is depicted in FIGS. 1, 2 and 3 where the keyholder is seen to comprise a loop of spring-like material formed into a closed path or ring lying in substantially a single plane with end portions 21 and 22 overlapping each other. The holder may be constructed from a length of round wire such as steel, beryllium copper, graphite, boron or other metallic alloys, or of a suitable plastic or other compound which can be formed into desired shape and has a springlike characteristic. The tips 23 and 24 of the overlapping end portions should reach to the outside of the curved parts 25 and 26 joining the overlapping portions to the remainder of the keyholder. FIG. 3 shows the key holder being held between thumb and finger prior to opening. On squeezing the keyholder between thumb and finger the loop is deformed as shown in FIG. 2 thereby opening the loop to receive or discharge a key.

The overlapping portion 21 and 22 must press tightly against each other to retain the key loop. It is necessary to prevent the ends 23 and 24 and end portions 21 and 22 from rotating about each other so as to contact each other along their "back" sides, or lose contact altogether resulting in opening of the keyholder loop to permit keys to fall off or out of the loop. This can be accomplished in a numer of ways, for example, by making the overlapping ends with flat sides pressing tightly against each other. It can also be accomplished by simply making the ends extend to the outermost part of the loop rounded corners 25 and 26 when it is at rest and not being squeezed.

Another way is to flatten the overlapping ends to broaden and thus enlarge the plane of abutment. Instead of one-piece construction, the overlapping ends can be separately made in satisfactory configuration and attached to the loop material in any conventional manner.

SECOND VERSION

Figure 4:
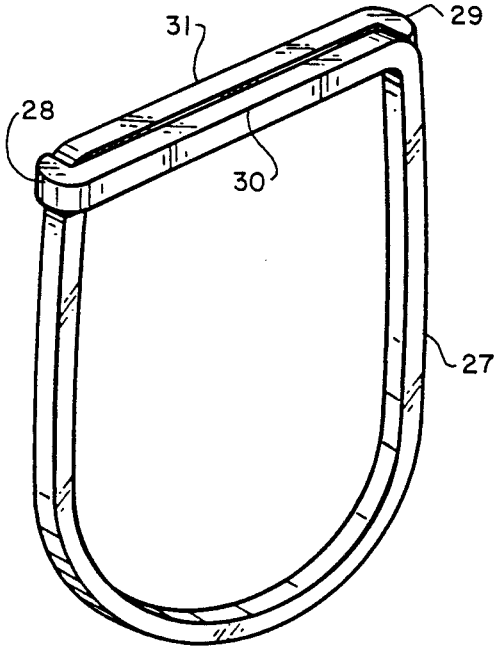
FIG. 4 is a perspective view of a second version in closed position.
Figure 5:
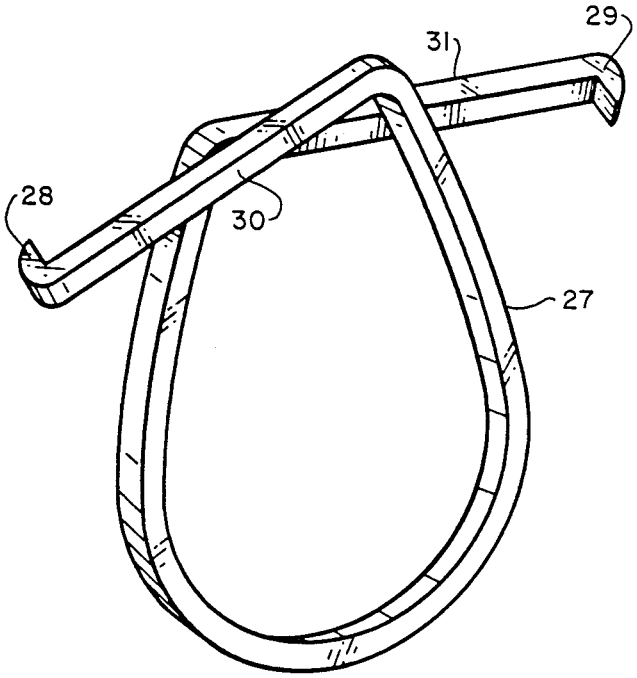
FIG. 5 shows FIG. 4 in "open position".
Figure 6:
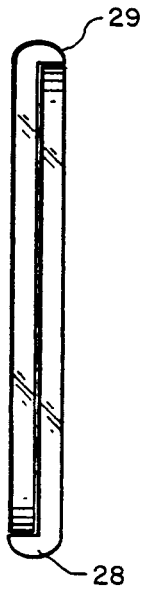
FIG. 6 is a top plan view of FIG. 4.

FIGS. 4, 5 and 6 show another embodiment of the invention which differs from that of FIGS. 1–3 primarily in that the tips 28 and 29 of the overlapping end portions 30 and 31, are formed into short hooks which extend at an angle transversely of the key holder plane and incidentally the body of the key holder loop 27 is ribbon shaped in cross section. It could as well have different cross sectional shape. The hook ends assure that after squeezing the sides to open the loop as shown in FIG. 5, the loop will return to its original configuration as in FIG. 4 upon cessation of squeezing. In addition, the hooks will prevent the contacting end portions from inadvertently rotating about each other so as to have their "back sides" toward each other.

THIRD VERSION

Figure 7:
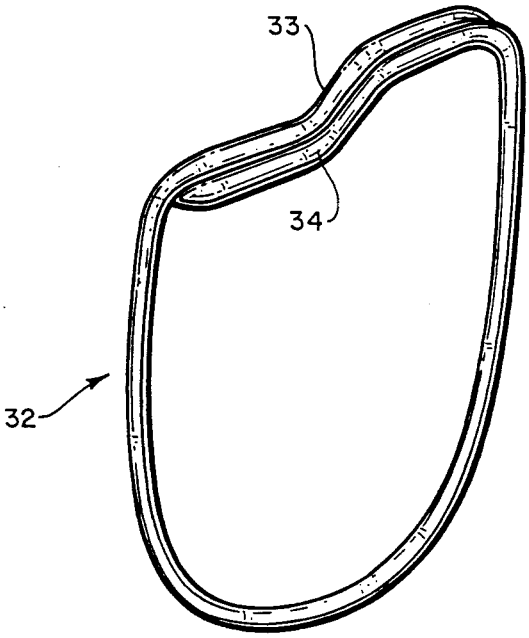
FIG. 7 is a perspective view of a third embodiment of the invention shown "closed".
Figure 8:
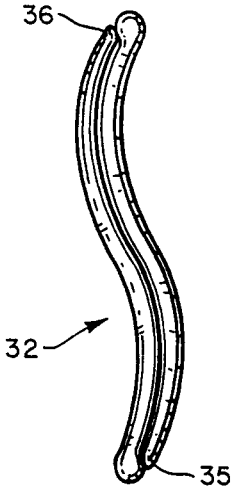
FIG. 8 shows a top plan view of the FIG. 7 version.
Figure 9:
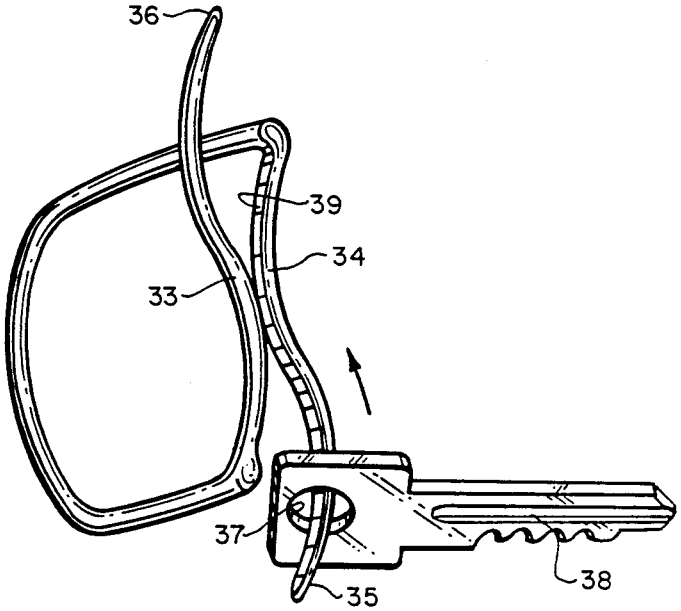
FIG. 9 is a perspective view of the FIG. 7 embodiment shown "open".

Reference is now made to FIGS. 7, 8 and 9 for the ensuing description of another embodiment of the key holder. As in the first described embodiment (FIGS. 1–3), the key holder is constructed of a loop 32 of springlike material having overlapping end portions 33 and 34. In this version, however, the end portions are elongated planar members which when viewed in plan (FIG. 8) are formed into a sinuous or "S" shape. When closed, the end portions nest within each other with their respective tips 35 and 36 being tapered so as to form a smooth surface that will not scratch the hands or tear the clothing.

In use, the key holder loop body is gripped between the thumb and index finger as shown in FIG. 3 and squeezed. This forces the sides of the holder toward each other in the loop plane causing the end portions to be moved out of nesting relation which cams the tips 35 and 36 apart as well as moving them outwardly of the respective holder sides (FIG. 9). The eye 37 of a key 38 may be threaded on one of the tips and moved in the space which now exists between the end portions 33 and 34. Further movement of the key in the same direction shown by arrow 39 in FIG. 9 forces the still contacting holder end portions apart and locates the key on the holder loop. On cessation of squeezing, the inherent spring characteristics of the holder cause it to resume the position of FIG. 7.

Removal of a key 38 from the holder is accomplished in much the same way as described for attaching a key, only the direction of key movement is different. First, the holder is gripped tightly enough to cause the tips to extend outwardly of the holder body as in FIG. 9. The key then slides along the loop toward one of the ends until the key eye 37 separates the end portions allowing the key to move off a tip 35 or 36, as the case may be.

It is contemplated that the end portions 33 and 34 have flattened contacting surfaces such as 39. One way of achieving this is to take an appropriate length of spring wire, for example, of uniform cross-section and flatten the end portions to the proper desired dimensions and condition. Another way is to make the end portions of separate pieces with flattened surfaces which are welded or silver soldered, for example, to a spring wire to complete the loop which produces a configuration substantially like is shown in FIG. 9.

ADDITIONAL VERSIONS

Figure 10:
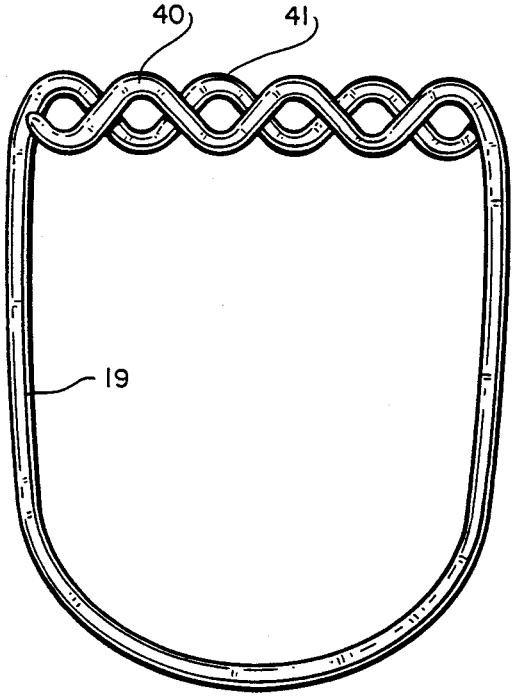
FIG. 10 is a perspective depiction of a fourth version of the invention.
Figure 11:
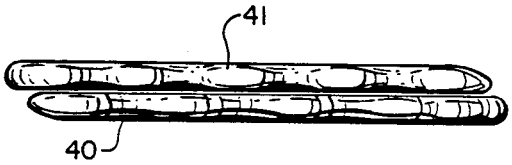
FIG. 11 is a top plan view of the key holder of FIG. 10.

FIG. 10 depicts a still further or fourth version of the invention differing primarily in that each overlapping end portion 40 and 41 includes a plurality of sinuous portions all lying in the plane of the holder main loop 42. As seen best in FIG. 11, the end portions are in smooth continuous contacting relation. Operation is the same as in the previously described embodiments.

Figure 12:
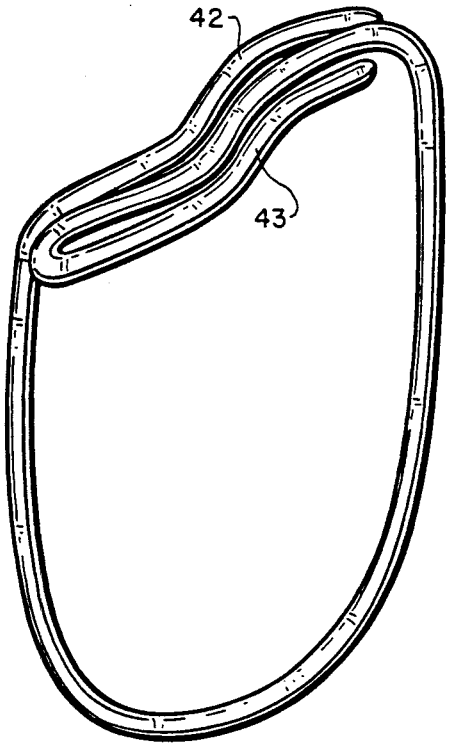
FIGS. 12 and 13 are perspective views of fifth and sixth embodiments, respectively.

Another or fifth version is shown in FIG. 12 primarily differing in having modified overlapping end portions 42, 43. More particularly, each end portion is formed by bending a length of the holder loop material back onto itself, and then shaping to the sinuous or "S" shape face contacting condition of FIGS. 7, 8 and 9. Each end portion, therefore, has a width equal to twice that of a holder side part which is advantageous in avoiding the manufacturing step for flattening the end portions such as in the FIG. 7 embodiment, for example.

Figure 13:
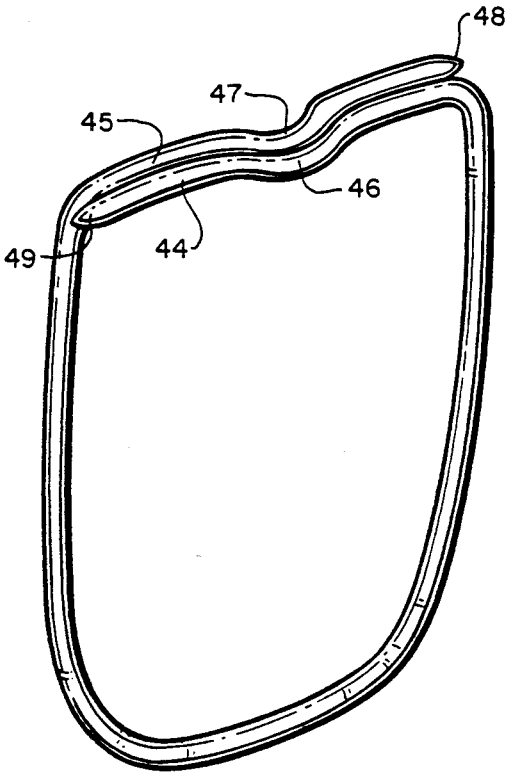

The sixth embodiment depicted in FIG. 13, has overlapping end portions 44 and 45 of the same dimensions as the remaining loop material. A bend 46 in end portion 44 nests with a similarly dimensioned complementary bend 47 in end portion 45 when the key holder is closed. Finger pressure on the holder sides causes the tips 48 and 49 to extend outwardly and to open for receiving a key. Preferably the abutting end portions should be flattened along the plane of abutting surfaces.

Although the various described versions are shown as having a loop body of round or rectangular crosssection, it is contemplated that all of them can be constructed of a body material having any of a great number of cross-sectional geometries and still be within the spirit of the invention.

I claim:

1. A finger pressure operable key holder, comprising:

an elongated one-piece body of springlike resilient spring metal wire formed into a closed loop with overlapping end portions parallel to each other along their lengths; and said overlapping end portions lying in continuous contacting relation with each other along facing surfaces;

said elongated body having a curved corner joining each overlapping end portion and a loop side with said loop sides extending generally transversely to the overlapping end portions;

and each overlapping end portion having a tip extending to and in contact with the corner of the opposite end portion, said tips being smoothly contoured on outwardly directed surfaces and free of sharp corners;

finger pressure applied to the loop sides urging them toward each other extends the tips beyond the loop sides for receiving a key eye thereon said tips forming means to assure that said overlapping end portions will return to their original relaxed condition when finger pressure on the key holder is relaxed upon cessation of squeezing.

2. A key holder as in claim 1, in which the elongated body is constructed of a material selected from the group consisting of spring steel and beryllium copper.

3. A key holder as in claim 1, in which facing surface of the overlapping end portions are flat.

4. A key holder as in claim 1, in which each tip is transversely bent to extend around the curved corner of the opposite end portion and in contact therewith.

5. A key holder as in claim 1, in which the elongate body is substantially square or rectangular in cross-section.

6. A key holder as in claim 1, in which the overlapping end portions are transversely of the general plane of the loop and the correspondingly curved facing surfaces nest with one another when the key holder is in relaxed condition, said curved facing surface camming the overlapping end portions apart when finger pressure is applied to the loop sides.

7. A key holder as in claim 6, in which the overlapping end portions each have a plurality of curves lying generally in the loop plane, with each contacting facing surface being generally a smooth flat plane.

8. A key holder as in claim 6, in which each overlapping end portion is formed by bending an end extent of the elongate body back onto itself so that the overlapping end portions are double thickness.

9. A key holder as in claim 1, in which one of the overlapping end portions includes a single, centrally located curved portion and the other overlapping end portion includes a single, complementary curved portion which nests with the first described curved portion when the key holder is at rest.

* * * * *